US006283903B1

(12) United States Patent
Onuki et al.

(10) Patent No.: US 6,283,903 B1
(45) Date of Patent: Sep. 4, 2001

(54) CONDUCTIVE RUBBER ROLLER

(75) Inventors: Akio Onuki, Ibaraki; Saburo Sonobe, Toride; Sadayuki Ishikura; Satoru Tani, both of Ibaraki, all of (JP)

(73) Assignee: Kinoyosha Co., Ltd., Tokyo (JP)

( * ) Notice: Subject to any disclaimer, the term of this patent is extended or adjusted under 35 U.S.C. 154(b) by 0 days.

(21) Appl. No.: 09/460,747

(22) Filed: Dec. 14, 1999

(30) Foreign Application Priority Data

Dec. 16, 1998 (JP) ..... 10-357670

(51) Int. Cl.[7] ..... B25F 5/02
(52) U.S. Cl. ..... 492/56; 492/53; 492/54
(58) Field of Search ..... 492/53, 54, 56; 428/335, 36.5

(56) References Cited

U.S. PATENT DOCUMENTS

| | | | | |
|---|---|---|---|---|
| 5,604,031 | * | 2/1997 | Yamamoto et al. | 428/335 |
| 5,656,344 | * | 8/1997 | Sawa et al. | 428/36.5 |
| 5,834,116 | * | 11/1998 | Sawa et al. | 492/56 |
| 5,985,423 | * | 11/1999 | Honda et al. | 428/212 |
| 6,064,847 | * | 5/2000 | Iwamatsu et al. | 399/283 |
| 6,090,492 | * | 7/2000 | Tsuchiya et al. | 492/53 |

* cited by examiner

*Primary Examiner*—I Cuda Rosenbaum
(74) *Attorney, Agent, or Firm*—Lackenbach Siegel Marzullo Aronson & Greenspan, P.C.

(57) ABSTRACT

Disclosed is a conductive rubber roller, comprising a core metal shaft, an ionic conductive layer formed to surround the outer circumferential surface of the core metal shaft and consisting of a high molecular weight elastomer containing an ionic conducting agent or a foamed body of such a high molecular weight elastomer, an electron conductive layer formed to surround the outer circumferential surface of the ionic conductive layer and consisting of a high molecular weight cellular elastomer containing an electron conducting agent or a high molecular weight cellular elastomer containing an electron conducting agent, a toner contamination preventing layer formed to surround the outer circumferential surface of the electron conductive layer, and an insulating annular sealing member mounted to each of both edges of the ionic conductive layer and the electron conductive layer both extending in the longitudinal direction of the metal core wherein a relationship R1>R2>R3, where R1, R2 and R3 denote, respectively, the electric resistance of the ionic conductive layer, the electron conductive layer and the toner contamination preventing layer, is satisfied, and the annular sealing member has an electric resistance of at least $10^{13}$ Ω·cm.

4 Claims, 6 Drawing Sheets

CONDUCTIVE RUBBER ROLLER

BACKGROUND OF THE INVENTION

The present invention relates to a conductive roll used in an image forming apparatus of an electrophotographic system such as a copying machine or a printer and to a method of manufacturing the same. To be more specific, the present invention relates to a conductive roller used as a charging roll for charging a surface of an image carrier, as a developing roll for coating an image carrier with a toner, and as a transfer roll for transferring the toner from the image carrier onto a paper sheet, and to a method of manufacturing the same.

FIG. 2 shows how various rolls are used. As shown in the drawing, a transfer roll 1 and an image carrier roll 2 serve to collectively transfer the toner from the image carrier onto a paper sheet 3. A charging roll 4 for charging a surface of the image carrier and a developing roll 5 for coating the image carrier with the toner are arranged in the vicinity of the image carrier roll 2. Further, a pair of fixing rolls 6 are arranged downstream of the transfer roll 1.

Known is a conductive member formed of a high molecular weight elastomer or a high molecular weight cellular elastomer (sponge body) mixed with an electron conducting agent such as a metal powder, a metal oxide powder, whiskers or a conductive carbon black to allow the conductive member to exhibit a predetermined electric resistance. The conventional conductive member of this type is defective in that the conductive member is greatly dependent on voltage, that the electric resistance is rendered nonuniform depending on portions of the roll product, and that the electric resistance of the conductive member is gradually increased during a continuous power supply. However, the conventional electron conductive member is advantageous in that a difference in electric resistance as measured under a voltage of 1 kV is small between a low temperature-low humidity environment (temperature of 10° C. and a relative humidity of 10%) and a high temperature-high humidity environment (temperature of 30° C. and a relative humidity of 80%).

Also known is a conductive member formed of a high molecular weight elastomer or a high molecular weight cellular elastomer (sponge body) mixed with an ionic conducting agent such as inorganic ionic substances including lithium perchlorate, sodium perchlorate or calcium perchlorate, a cationic surfactant, an amphoteric ionic surfactant, or an organic ionic substance such as tetraethyl ammonium perchlorate (or butyl ammonium) to control the electric resistance of the conductive member at a predetermined value. The ionic conductive member of this type is defective in that there is a large difference in electric resistance as measured under a voltage of 1 kV between a low temperature-low humidity environment (temperature of 10° C. and a relative humidity of 10%) and a high temperature-high humidity environment (temperature of 30° C. and a relative humidity of 80%). However, the ionic conductive member of this type produces a merit, which is not produced by the electron conducting conductive member, that the voltage dependence, i.e., difference in electrical resistance produced when the voltage is changed, is low.

As described above, the conventional electron conducting conductive member containing an electron conducting agent such as a conductive carbon black or a metal oxide powder exhibits a high voltage dependence (i.e., the change in electric resistance caused by the change in voltage is large), resulting in failure to obtain a constant electric resistance. Therefore, when applied to, for example, a developing roll, the electron conductive member fails to obtain a predetermined amount of charge. As a result, the toner attached to the developing roll is rendered nonuniform in density, resulting in failure to obtain a high quality image.

Likewise, when the conventional electron conductive member is applied to a transfer roll, the nonuniformity in the resistance value of the electron conductive member causes the toner transferred onto the paper sheet to be nonuniform in density. It is impossible to obtain a high quality image in this case, too.

On the other hand, the ionic conductive member containing ionic conducting agent such as lithium perchlorate or a cationic ionic surfactant gives rise to a large difference in the electric resistance between a low temperature-low humidity environment and a high temperature-high humidity environment, making it difficult to obtain a constant electric resistance throughout the four seasons of a year. It follows that, when applied to, for example, a developing roll, a stable electric resistance cannot be obtained. To be more specific, the amount of charging is rendered highly nonuniform depending on the change in the environment. As a result, the developed toner is rendered unstable, leading to failure to obtain a high quality image.

BRIEF SUMMARY OF THE INVENTION

An object of the present invention is to provide a conductive rubber roller, which permits exhibiting a stable resistance regardless of changes in voltage, and which permits diminishing the difference in electric resistance between a low temperature-low humidity environment and a high temperature-high humidity environment so as to form stably a high quality image constantly. The present invention is intended to overcome the above-noted defects inherent in the conventional conductive roll used in an image forming apparatus and utilizes in combination the merit of the electron conducting conductive member obtained by mixing an electron conducting agent and the merit of the ionic conductive member obtained by mixing an ionic conducting agent.

According to a first aspect of the present invention, there is provided a conductive rubber roller, comprising a metal core connected to a power source, an ionic conductive layer containing an ionic conducting agent and formed to surround the outer surface of the metal core, and an electron conductive layer formed to surround the outer surface of the ionic conductive layer and consisting of a high molecular weight elastomer containing an electron conducting agent or a cellular elastomer of a high molecular weight elastomer containing an electron conducting agent, wherein the ionic conductive layer consists of a high molecular weight elastomer, a polymer alloy thereof, a high molecular weight cellular elastomer, or a polymer alloy, and an electric resistance R1 of the ionic conductive layer is higher than an electric resistance R2 of the electron conductive layer (R1>R2).

According to a second aspect of the present invention, there is provided a conductive rubber roller, comprising a metal core connected to a power source, an ionic conductive layer containing an ionic conducting agent and formed to surround the outer surface of the metal core, an electron conductive layer formed to surround the outer surface of the ionic conductive layer and consisting of a high molecular weight elastomer containing an electron conducting agent or a high molecular weight cellular elastomer containing an electron conducting agent, and an insulating annular sealing member mounted to each of both edges of the ionic conductive layer and the electron conductive layer both extending in a longitudinal direction of the metal core, wherein the ionic conductive layer consists of a high molecular weight elastomer, a polymer alloy thereof, a high molecular weight cellular elastomer, or a polymer alloy thereof, an electric resistance R1 of the ionic conductive layer is higher than an electric resistance R2 of the electric conductive layer (R1>R2), and the annular sealing member exhibits an electric resistance of at least $10^{13}$ Ω·cm.

According to a third aspect of the present invention, there is provided a method of manufacturing a conductive rubber roller, comprising the steps of extruding a high molecular weight elastomer containing an ionic conducting agent or a cellular material prepared by adding a blowing agent to the high molecular weight elastomer onto an outer surface of a metal core connected to a power source, followed by heating the extrudate for vulcanizing or foaming the extrudate and subsequently polishing the surface of the extrudate to a predetermined size to form an ionic conductive layer; preparing a mandrel having an outer diameter conforming with the outer diameter of the ionic conductive layer formed on the metal core and extruding a kneaded mass consisting of a high molecular weight elastomer and an electron conducting agent onto the outer surface of the mandrel, followed by heating the extrudate for vulcanizing the extrudate and subsequently withdrawing the mandrel to prepare a tube of an electron conductive layer; fitting the tube onto the outer circumferential surface of the ionic conductive layer with an adhesive interposed therebetween; and forming an insulating annular sealing member on each of both edges of the ionic conductive layer and the electron conductive layer both extending in a longitudinal direction of the first mandrel.

According to a fourth aspect of the present invention, there is provided a method of manufacturing a conductive rubber roller, comprising the steps of preparing a mandrel having an outer diameter conforming with the outer diameter of an ionic conductive layer and extruding a kneaded mass consisting of a high molecular weight elastomer and an electron conducting agent onto the outer surface of the mandrel, followed by heating the extrudate for vulcanizing the extrudate and subsequently withdrawing the mandrel to prepare a tube of an electron conductive layer; setting a metal core in the center of the tube by using a mold, followed by mechanically stirring a liquid high molecular weight elastomer mixed with an ionic conducting gent to mix air with the elastomer and subsequently pouring the mixed elastomer into the tube set in the mold and heating the mixed elastomer for curing the elastomer so as to form an ionic conductive layer; and removing the mold, followed by forming an insulating annular sealing member at each of both edges of the ionic conductive layer and the electron conductive layer both extending in the longitudinal direction of the mandrel.

According to a fifth aspect of the present invention, there is provided a method of manufacturing a conductive rubber roller, comprising the steps of kneading a mixture consisting of a high molecular weight elastomer or a polymer alloy thereof, an ionic conducting agent and a foaming agent to prepare a composite of an ionic conductive layer formed on the outer circumferential surface of a metal core; kneading a mixture consisting of a high molecular weight elastomer or a polymer alloy thereof and an electron conducting agent to prepare a composite of an electron conductive layer formed on the outer circumferential surface of the ionic conductive layer; extruding the composite of the ionic conductive layer and the composite of the electron conductive layer onto a metal core by a twin screw type extruder to form the ionic conductive layer and the electron conductive layer by a single extruding operation; heating the extrudate for vulcanizing and foaming the extrudate; and forming an insulating annular sealing member on each of both edges of the ionic conductive layer and the electron conductive layer both extending in the longitudinal direction of the metal core.

Further, according to a sixth aspect of the present invention, there is provided a method of manufacturing a conductive rubber roller, comprising the steps of kneading a mixture consisting of a high molecular weight elastomer or a polymer alloy thereof, an ionic conducting agent and a foaming agent to prepare a composite of an ionic conductive layer formed on the outer circumferential surface of a metal core; extruding the composite onto a metal core to form an ionic conductive layer; kneading a mixture consisting of a high molecular weight elastomer or a polymer alloy thereof and an electron conducting agent to prepare a composite of an electron conductive layer formed on the outer circumferential surface of the ionic conductive layer; adding a solvent to the kneaded composite to prepare a paste; extruding the paste onto the outer circumferential surface of an unvulcanized roll extruded in advance, followed by evaporating the solvent of the paste to form an electron conductive layer; heating the extrudate to vulcanize the extrudate; forming an insulating annular sealing member at each of both edges of the ionic conductive member and the electron conductive layer both extending in the longitudinal direction of the core metal shaft; and grinding the surface of the resultant roll to a predetermined size.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

According to a first aspect of the present invention, there is provided a conductive roll, comprising a core metal shaft connected to a power source, an ionic conductive layer containing an ionic conducting agent and formed to surround the outer surface of the metal core, and an electron conductive layer formed to surround the outer surface of the ionic conductive layer and consisting of a high molecular weight elastomer containing an electron conducting agent or a foamed body of a high molecular weight elastomer containing an electron conducting agent, wherein said ionic conductive layer consists of a high molecular weight elastomer, a polymer alloy thereof, a high molecular weight cellular elastomer, or a polymer alloy thereof, and an electric resistivity R1 of said ionic conductive layer is higher than an electric resistivity R2 of said electron conductive layer (R1>R2).

The first aspect of the present invention is featured in that the ionic conductive layer is low in its voltage dependence and small in unevenness of the electric resistance depending on positions of the roll product. The first aspect of the present invention will now be described in detail.

Figure 13:
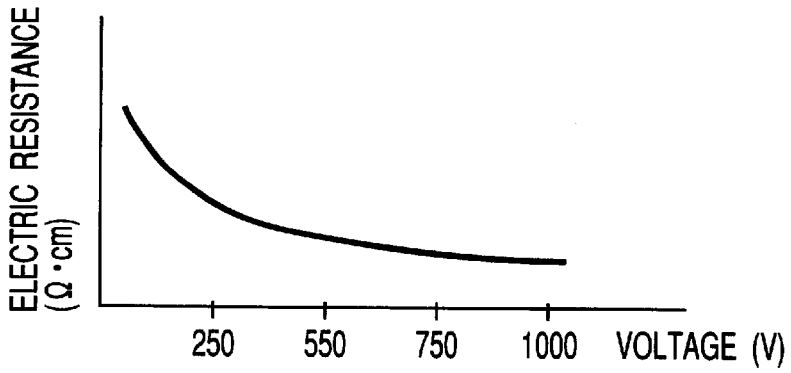
FIG. 13 is a graph showing the relationship between the electric resistance and the voltage in the electron conductive layer included in the conductive roll of the present invention.
Figure 14:
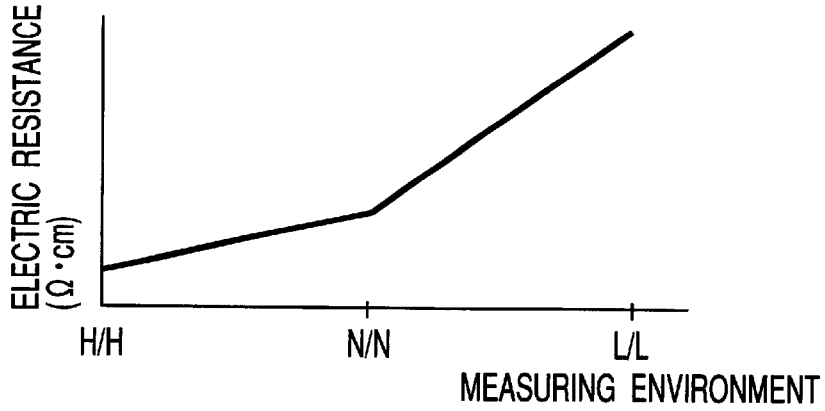
FIG. 14 is a graph showing the relationship between the electric resistance and the measuring environment in the ionic conductive layer included in the conductive roll of the present invention.
Figure 15:
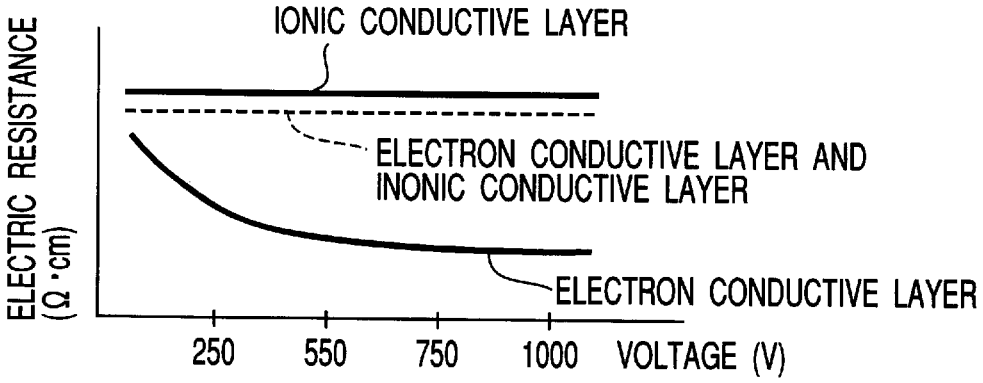
FIG. 15 is a graph showing the relationship between the electric resistance and the voltage, covering the case where an electron conductive layer and an ionic conductive layer are utilized in combination in the present invention.

Specifically, in the conductive roll comprising an electron conductive layer formed on the outer circumferential surface of a core metal shaft, the resistance is increased with decrease of voltage, as shown in FIG. 13. In other words, the electron conductive layer has a large voltage dependence. On the other hand, in the conductive roll comprising an ionic conductive layer formed on the outer circumferential surface of a metal core, the resistance is changed depending on the measuring environment, i.e., {H/H (High Temperature/High Humidity), N/N (Normal Temperature/Normal Humidity), and L/L (Low Temperature/Low Humidity)}, as shown in FIG. 14. In other words, the ionic conductive layer has a high dependence on the measuring environment. In the present invention, these two defects are overcome by using an electron conductive layer and an ionic conductive layer in combination. To be more specific, an electron conductive layer is formed on the outer circumferential surface of an ionic conductive layer so as to provide a conductive roll capable of maintaining a constant electric resistance regardless of the voltage and the measuring environment. It is important to note that the electric resistance of the upper electron conductive layer is set lower than the electric resistance of the lower ionic conductive layer in the present invention regardless of the voltage applied for measuring the electric resistance, as shown in FIG. 15.

In the first aspect of the present invention, an ionic conductive layer containing an ionic conducting agent is used as a lower layer. Also, an electron conductive layer formed of a high molecular weight elastomer containing an electron conducting agent or a foamed body of a high molecular weight elastomer containing an electron conducting agent is used as an upper layer. In addition, the electric resistance of the lower layer is set higher than that of the upper layer. The particular construction makes it possible to provide a developing roll or a transfer roll for an electrophotographic image forming apparatus capable of eliminating the voltage dependence and the environment dependence of the electrical resistance so as to achieve a stable image formation under any environment.

According to a second aspect of the present invention, there is provided a conductive rubber roller, comprising a metal core connected to a power source, an ionic conductive layer containing an ionic conducting agent and formed to surround the outer surface of the metal core, an electron conductive layer formed to surround the outer surface of the ionic conductive layer and consisting of a high molecular weight elastomer containing an electron conducting agent or a high molecular weight cellular elastomer containing an electron conducting agent, and an insulating annular sealing member mounted to each of both edges of said ionic conductive layer and said electron conductive layer both extending in a longitudinal direction of the metal core, wherein said ionic conductive layer consists of a high molecular weight elastomer, a polymer alloy thereof, a high molecular weight cellular elastomer, or a polymer alloy thereof, an electric resistivity R1 of said ionic conductive layer is higher than an electric resistivity R2 of said electron conductive layer (R1>R2), and said annular sealing member exhibits an electric resistivity of at least $10^{13}$ Ω·cm.

In each of the first and second aspects of the present invention, it is possible to mount a conductive paint and a conductive high molecular weight elastomer on the outer circumferential surface of the electron conductive layer. The high molecular weight elastomer includes, for example, a toner contamination preventing layer. In this case, it is desirable to meet the relationship R1>R2>R3, where R3 represents the electric resistivity of the toner contamination preventing layer.

The ionic conductive layer included in each of the first and second aspects of the present invention includes (1) a high molecular weight elastomer, (2) a polymer alloy (polymer blend) of a high molecular weight elastomer, (3) a high molecular weight cellular elastomer, and (4) a polymer alloy of a high molecular weight cellular elastomer.

In the second aspect of the present invention, it is necessary for the annular sealing member to be adhered or bonded to the core metal shaft, the ionic conductive member and the electron conductive member, and to be low in permeability of humidity.

Figure 9:
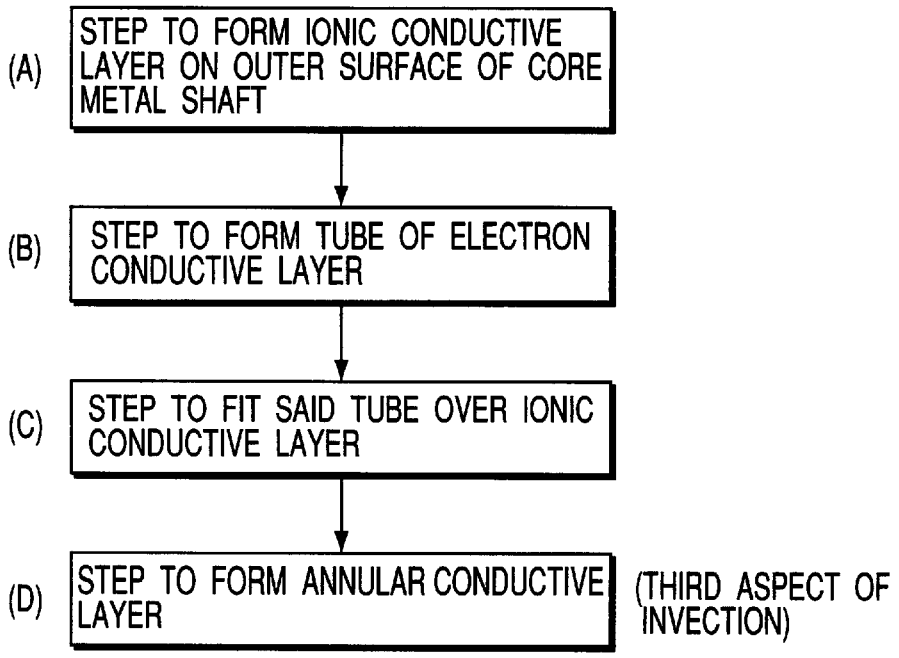
FIG. 9 is a flow chart showing a method of manufacturing a conductive roll according to a third embodiment of the present invention.

According to a third aspect of the present invention, there is provided a method of manufacturing a conductive rubber roller, comprising the steps of extruding a high molecular weight elastomer containing an ionic conducting agent or a cellular material prepared by adding a foaming agent to said high molecular weight elastomer onto an outer surface of a metal core connected to a power source, followed by heating the extrudate for vulcanizing or foaming the extrudate and subsequently polishing the surface of the extrudate to a predetermined size to form an ionic conductive layer; preparing a mandrel having an outer diameter conforming with the outer diameter of the ionic conductive layer formed on said metal core and extruding a kneaded mass consisting of a high molecular weight elastomer and an electron conducting agent onto the outer surface of said mandrel, followed by heating the extrudate for vulcanizing the extrudate and subsequently withdrawing the mandrel to prepare a tube of an electron conductive layer; fitting said tube onto the outer circumferential surface of said ionic conductive layer with an adhesive interposed therebetween; and forming an insulating annular sealing member on each of both edges of the ionic conductive layer and the electron conductive layer both extending in a longitudinal direction of the first mandrel. FIG. 9 shows the flow of the manufacturing method according to the third aspect of the present invention.

In the third aspect of the present invention, a tube forming the electron conductive layer is fitted over the outer circumferential surface of the ionic conductive layer. Where the tube of the electron conductive layer is longer than a predetermined value, it is desirable to cut away both edge portions of the tube to a predetermined size. Also, after formation of the insulating annular sealing member on both edge portions of the ionic conductive layer and the electron conductive layer, it is desirable to grind the outer surface of the roll (electron conductive layer) to a predetermined size.

Figure 10:
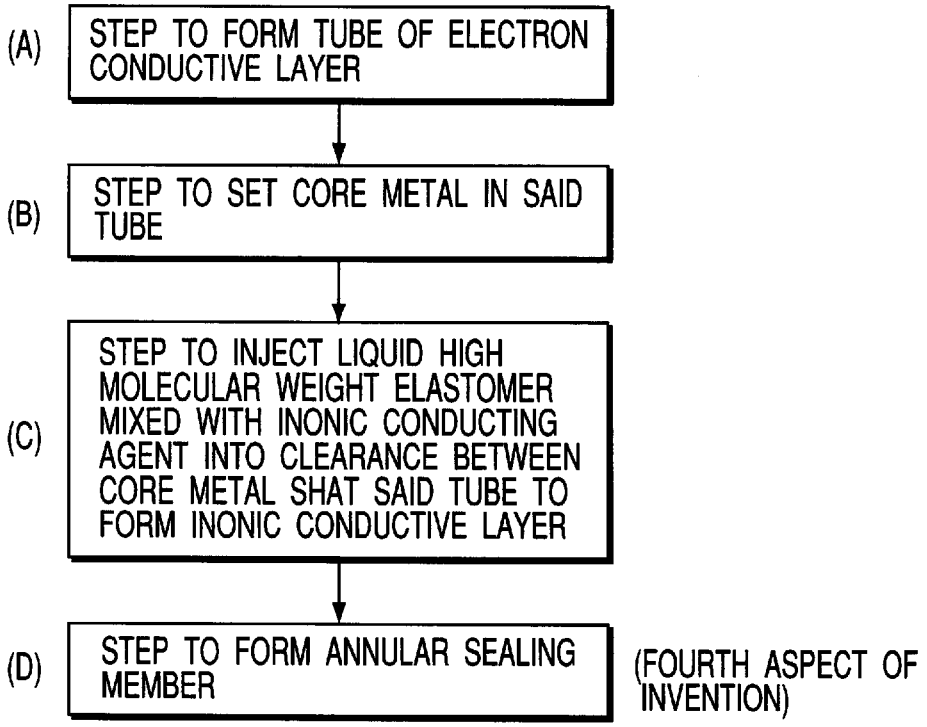
FIG. 10 is a flow chart showing a method of manufacturing a conductive roll according to a fourth embodiment of the present invention.

According to a fourth aspect of the present invention, there is provided a method of manufacturing a conductive rubber roller, comprising the steps of preparing a mandrel having an outer diameter conforming with the outer diameter of an ionic conductive layer and extruding a kneaded mass consisting of a high molecular weight elastomer and an electron conducting agent onto the outer surface of said mandrel, followed by heating the extrudate for vulcanizing the extrudate and subsequently withdrawing the mandrel to prepare a tube of an electron conductive layer; setting a metal core in the center of the tube by using a mold, followed by mechanically stirring a liquid high molecular weight elastomer mixed with an ionic conducting agent to mix air with the elastomer and subsequently pouring the mixed elastomer into the tube set in the mold and heating the mixed elastomer for curing the elastomer so as to form an ionic conductive layer; and removing the mold, followed by forming an insulating annular sealing member at each of both edges of the ionic conductive layer and the electron conductive layer both extending in the longitudinal direction of the mandrel. FIG. 10 shows the flow of the manufacturing process according to the fourth aspect of the present invention.

In the fourth aspect of the present invention, a tube forming the electron conductive layer is fitted over the outer circumferential surface of the ionic conductive layer. Where the tube of the electron conductive layer is longer than a predetermined value, it is desirable to cut away both edge portions of the tube to a predetermined size. Also, after formation of the insulating annular sealing member on both edge portions of the ionic conductive layer and the electron conductive layer, it is desirable to polish the outer surface of the roll (electron conductive layer) to a predetermined size.

Figure 11:
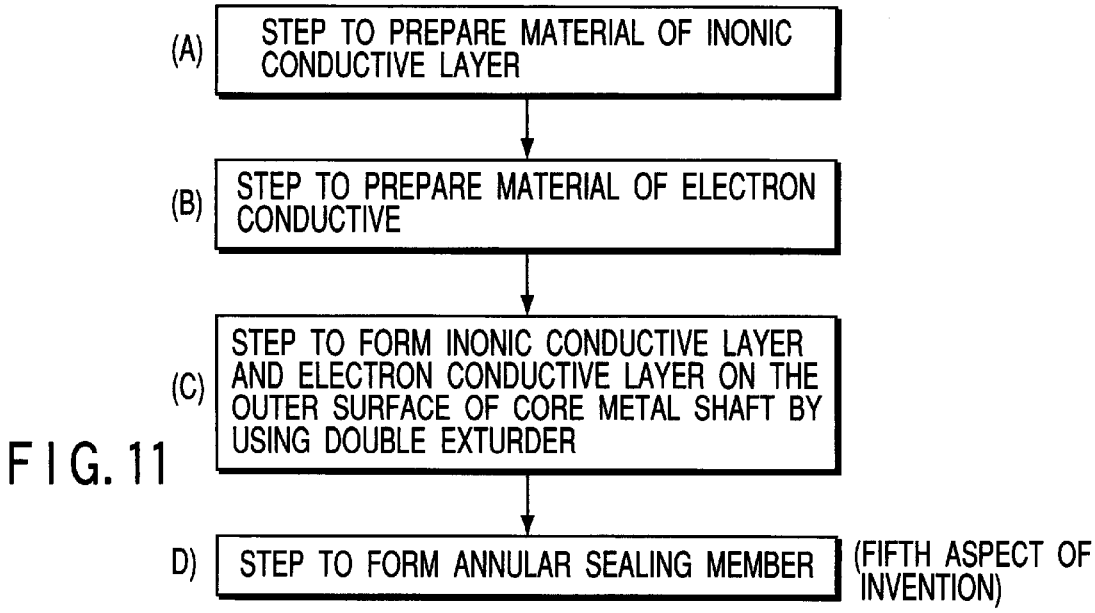
FIG. 11 is a flow chart showing a method of manufacturing a conductive roll according to a fifth embodiment of the present invention.

According to a fifth aspect of the present invention, there is provided a method of manufacturing a conductive rubber roller, comprising the steps of kneading a mixture consisting of a high molecular weight elastomer or a polymer alloy thereof, an ionic conducting agent and a foaming agent to prepare a composite of an ionic conductive layer formed on the outer circumferential surface of a metal core; kneading a mixture consisting of a high molecular weight elastomer or a polymer alloy thereof and an electron conducting agent to prepare a composite of an electron conductive layer formed on the outer circumferential surface of said ionic conductive layer; extruding said composite of the ionic conductive layer and said composite of the electron conductive layer onto a metal core by a twin screw type extruder to form said ionic conductive layer and said electron conductive layer by a single extruding operation; heating the extrudate for vulcanizing and foaming the extrudate; and forming an insulating annular sealing member on each of both edges of the ionic conductive layer and the electron conductive layer both extending in the longitudinal direction of the metal core. FIG. 11 shows the flow of the manufacturing process according to the fifth aspect of the present invention.

Figure 12:
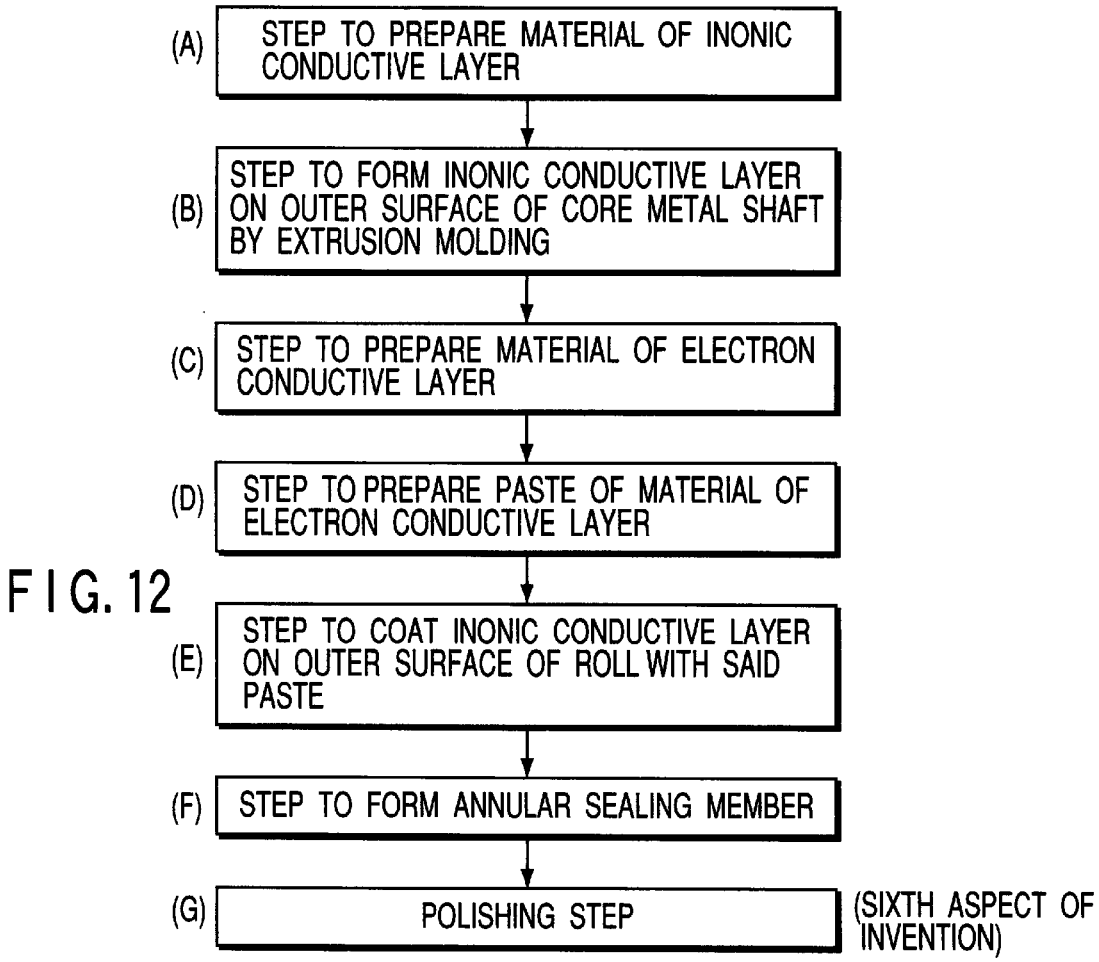
FIG. 12 is a flow chart showing a method of manufacturing a conductive roll according to a sixth embodiment of the present invention.

Further, according to a sixth aspect of the present invention, there is provided a method of manufacturing a conductive rubber roller, comprising the steps of kneading a mixture consisting of a high molecular weight elastomer or a polymer alloy thereof, an ionic conducting agent and a blowing agent to prepare a composite of an ionic conductive layer formed on the outer circumferential surface of a metal core; extruding said composite onto a metal core to form an ionic conductive layer; kneading a mixture consisting of a high molecular weight elastomer or a polymer alloy thereof and an electron conducting agent to prepare a composite of an electron conductive layer formed on the outer circumferential surface of said ionic conductive layer; adding a solvent to the kneaded composite to prepare a paste; extruding said paste onto the outer circumferential surface of an unvulcanized roll extruded in advance, followed by evaporating the solvent of the paste to form an electron conductive layer; heating the extrudate to vulcanize or foam the extrudate; forming an insulating annular sealing member at each of both edges of the ionic conductive member and the electron conductive layer both extending in the longitudinal direction of the metal core; and polishing the surface of the resultant roll to a predetermined size. FIG. 12 shows the flow of the manufacturing process according to the sixth aspect of the present invention.

Where rubber is used in the present invention as the high molecular weight elastomer, a crosslinking agent such as sulfur or peroxide, an antioxidant, a crosslinkage accelerator, a plasticizer and a conducting agent are kneaded with natural rubber (NR), nitrile rubber (NBR), butadiene rubber (BR), styrene-butadiene rubber (SBR), isoprene rubber (IR), ethylene-propylene rubber (EPM, EPDM) or a polymer alloy thereof, followed by molding and vulcanizing the kneaded mixture and subsequently grinding the vulcanizate to a predetermined size. In the case of forming a foamed body, a blowing agent is added to the kneaded mixture, followed by molding and vulcanizing the kneaded mixture and subsequently grinding the vulcanizate to a predetermined size.

In the case of using a liquid high molecular weight elastomer, a chain elongating agent such as tolylene diisocyanate (TDI) or diphenyl methane diisocyanate (MDI) or a crosslinking agent, a conducting agent, a catalyst or foam stabilizer is mixed with polyether polyol, polyester polyol or another liquid elastomer material, followed by molding the mixture in a desired shape by using a mold. In the case of forming a foamed body, a blowing agent is further added to the mixture, followed by vulcanizing and molding the resultant mixture in a desired shape and subsequently polishing the molding to a desired size. Alternatively, air is mechanically added to the mixture and the resultant mixture is injected into a mold, followed by heating the mold to cure the molding and subsequently releasing the molding from the mold. Finally, the molding is polished to a predetermined size.

The conducting agents used in the conductive members included in the conductive roll of the present invention can be classified into an electron conducting agent and an ionic conducting agent. The electron conducting agent includes a conductive carbon black, a metal powder, a metal oxide or a surface treated metal oxide prepared by applying a conductive treatment to a metal oxide. On the other hand, the ionic conducting agent includes charge transfer substances such as epichlorohydrin rubber, tetracyano ethylene and its derivative, benzoquinone and its derivative, ferrocene and its derivative, dichloro dicyano benzoquinone and its derivative and phthalocyanine and its derivative; inorganic ionic substances such as lithium perchlorate, sodium perchlorate and calcium perchlorate; cationic surfactants; and amphoteric surfactants.

The foaming agent used in the present invention includes chemical blowing agents. Typical examples of the chemical blowing agents are sodium bicarbonate as an inorganic compound, Cellular D (trade name of a nitroso series compound of DPT manufactured by Eiwa Chemical Ind., Co., Ltd.), Vinyfor AC (trade name of an azo series compound of azodicarbonamide manufactured by Eiwa Chemical Ind., Co., Ltd.), and Neocellborn N1000 (trade name of a sulfonyl hydrazide series compound of benzenesulfonyl hydrazide). Also, as a general foaming method, it is possible to introduce bubbles mechanically into a liquid high molecular weight elastomer.

The toner contamination preventing layer included in the conductive roll of the present invention is formed of a material selected from the group including, for example, FE-3000 (trade name of an FEVA-modified fluorine-containing resin paint manufactured by Asahi Glass K.K.), Aquatop F (trade name of fluorinecontaining polyol-modified fluorine-containing resin paint manufactured by Sumitomo Seila Chemicals, Co., Ltd.), Kampeflon 10 (trade name of a PVDF-modified fluorine-containing resin paint manufactured by kansai Paind, Co., Ltd.), Elastflon FT20Z505 (trade name of a polyurethane-modified fluorine-containing resin paint manufactured by Nippon Miractran, Co., Ltd.), Emralon 312 (trade name of acryl-modified fluorine-containing resin paint manufactured by Acheson (Japan), Ltd.), Emralon 314 (trade name of epoxy-modified fluorinecontaining resin paint manufactured by Acheson (Japan), Ltd.), Emralon 328 (trade name of cellulose-modified fluorine-containing resin paint manufactured by Acheson (Japan), Ltd.), Emralon 330 (trade name of phenolmodified fluorine-containing resin paint manufactured by Nippon Atison K.K.), Emralon 333 (trade name of PAI-modified fluorine-containing resin paint manufactured by Acheson (Japan), Ltd.), KR5206 (trade name of an alkyd-modified silicone paint manufactured by Shin-Etsu Chemical Co., Ltd.), ES1004 (trade name of an epoxy-modified silicone paint manufactured by Shin-Etsu Chemical Co., Ltd.), KR9706 (trade name of an acryl-modified silicone paint manufactured by Shin-Etsu Chemical Co., Ltd.), and KR 5203 (trade name of a polyester-modified silicone paint manufactured by Shin-Etsu Chemical Co., Ltd.). The toner contamination preventing layer can be formed by, for example, coating a toner contamination preventing agent by a spray method, though the formation is not limited to the particular method.

Figure 6:
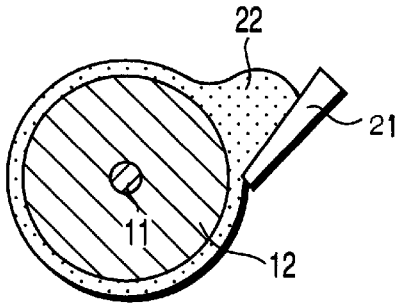
FIG. 6 covers a case where an ionic conductive layer is formed by coating a core metal shaft with a paste.
Figure 7:
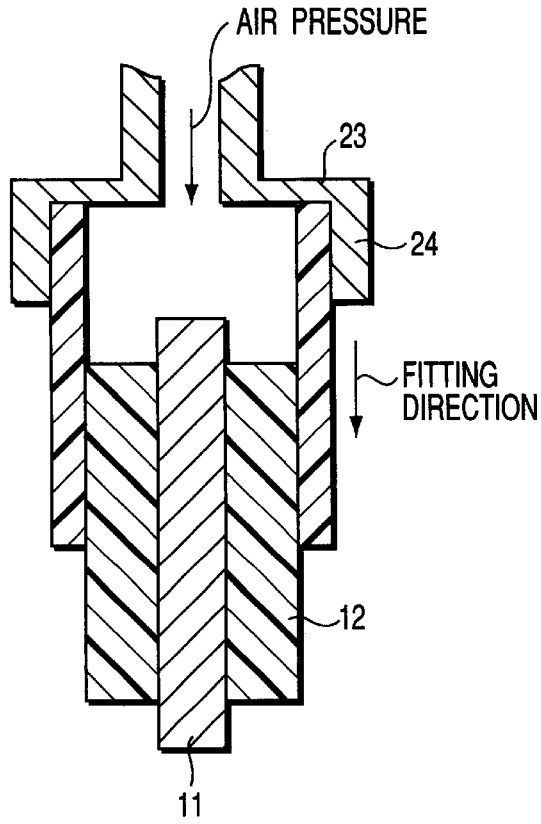
FIG. 7 shows a fitting method for forming a conductive roll of the present invention.

FIG. 6 shows how to coat the outer circumferential surface of an unvulcanized roll with a paste prepared by adding a solvent to a kneaded mixture. As shown in the drawing, a doctor knife 21 is arranged in the vicinity of the outer circumferential surface of the unvulcanized roll, and the paste 22 is put in the space defined by the doctor knife 21 and the outer circumferential surface of the unvulcanized roll. Under this condition, the metal core 11 is rotated so as to permit the outer surface of the roll to be coated with the paste 22. Then, the roll is dried to evaporate the solvent, followed by heating the roll for vulcanization so as to form an electron conductive cellular layer.

Figure 1:
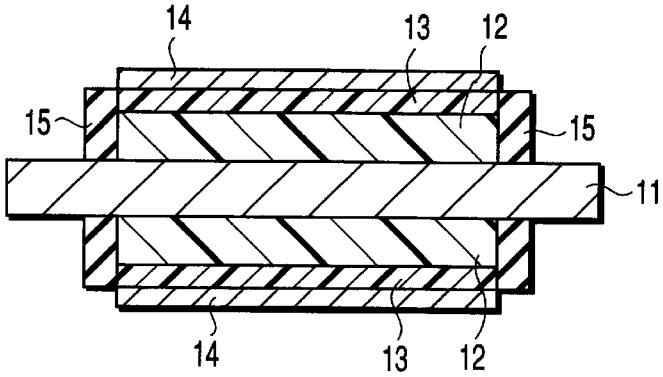
FIG. 1 is a cross sectional view showing a conductive roll according to one embodiment of the present invention.

Conductive rolls of the present invention will now be described as Examples of the present invention together with a conductive roll for a Comparative Example with reference to the accompanying drawings. Each of these conductive rolls is constructed as shown in FIG. 1. As shown in the drawing, the conductive roll includes a metal core 11 connected to a power source (not shown). An ionic conductive layer 12 consisting of a high molecular weight elastomer containing an ionic conducting agent, or a cellular material of such a high molecular weight elastomer, is formed to cover the outer circumferential surface of the metal core 11. An electron conductive layer 13 consisting of a high molecular weight elastomer containing an electron conducting agent (or a cellular material of such a high molecular weight elastomer) is formed to surround the outer circumferential surface of the ionic conductive layer 12. A toner contamination preventing layer 14 containing a conducting agent is formed to surround the outer circumferential surface of the electron conductive layer 13. Further, an insulating annular sealing member 15 is mounted to each of both edges of the ionic conductive layer 12 and the electron conductive layer 13 both extending in the longitudinal direction of the metal core 11 with an adhesive (not shown) interposed therebetween. The annular sealing member has an electrical resistivity of at least $10^{13}$ Ω·cm. Also, these ionic conductive layer 12, electron conductive layer 13 and toner contamination preventing layer 14 are set to satisfy the condition R1>R2>R3, where R1 represents the electrical resistance of the ionic conductive layer 12, R2 represents the electrical resistance of the electron conductive layer 13, and R3 represents the electrical resistance of the toner contamination preventing layer 14.

As described above, the conductive roll shown in FIG. 1 comprises the metal core 11, the ionic conductive layer 12 formed to surround the outer circumferential surface of the metal core 11, the electron conductive layer 13 formed to surround the outer circumferential surface of the ionic conductive layer 12, the toner contamination preventing layer 14 formed to surround the outer circumferential surface of the electron conductive layer 13, and the annular sealing member 15 mounted to each of both edges of the ionic conductive layer 12 and the electron conductive layer 13 both extending in the longitudinal direction of the metal core 11. The annular sealing member has an electrical resistivity of at least $10^{13}$ Ω·cm. Also, the relationship R1>R2>R3, where R1 represents the electrical resistance of the ionic conductive layer 12, R2 represents the electrical resistance of the electron conductive layer 13, and R3 represents the electrical resistance of the toner contamination preventing layer 14, is satisfied.

The particular construction makes it possible to provide a conductive roll, in which the electrical resistance is low in its dependence on the applied voltage, and the change in the electrical resistance depending on the environment, i.e., temperature and humidity, is small. Also, if the conductive roll of the present invention is used as the charging roll 4, the developing roll 5 or the transfer roll 1 of the image forming apparatus shown in FIG. 2, a satisfactory image can be obtained with a high stability.

How to manufacture the conductive roll of the particular construction described above will now be described.

COMPARATIVE EXAMPLE 1

1) Formation of the Ionic Conductive Layer 12:

A raw material blend rubber consisting of 70 parts by weight of epichlorohydrin rubber and 30 parts by weight of NBR was mixed with a vulcanizing agent, a filler and 10 part by weight of an azo compound series blowing agent. The mixture was kneaded, followed by extruding the kneaded mixture onto the outer circumferential surface of the metal core 11. Then, the extrudate was heated for vulcanization to obtain a cellular elastic layer, which was found to be sponge-like, followed by polishing the heat-treated extrudate to a predetermined size so as to form the ionic conductive layer 12. The electrical resistance of the ionic conductive layer 12 was measured by applying voltage across the ionic conductive layer 12. Curve (A) given in the graph of FIG. 3 denotes the results. As apparent from curve (A), the ionic conductive layer 12 exhibited a substantially constant resistivity of $10^7$ Ω·cm regardless of the magnitude of the applied voltage. Also, the ionic conductive layer 12, which was sponge-like, was found to have fine cells having an average cell diameter of 150 to 300 μm, and was also found to have a rubber hardness of 25 to 28 as measured in accordance with the method defined in JIS (Japanese Industrial Standards) E.

2) Formation of the Electron Conductive Layer 13:

A raw material rubber consisting of 100 parts by weight of EPDM (ethylene-propylene-diene rubber) was mixed with 10 parts by weight of a vulcanizing agent, a plasticizer, a filler and an azo compound series foaming agent, 23 parts by weight of HAF (carbon black), and 15 parts by weight of a conductive zinc oxide. The mixture was kneaded and, then, extruded onto the outer circumferential surface of a mandrel having an outer diameter conforming with the outer circumferential surface of the ionic conductive layer 12, followed by heating the extrudate for vulcanization of the extrudate and subsequently withdrawing the mandrel so as to prepare a tube forming the electron conductive layer 13. The electrical characteristics of the tube were measured, with the result that the electric resistivity was found to be greatly dependent on the applied voltage as apparent from curve (B) given in the graph of FIG. 3. Specifically, the resistivity of the electron conductive layer 13 was found to be higher than that of the ionic conductive layer 12 in the case where the applied voltage was lower than 125V. However, where the applied voltage was higher than 125V, the resistivity of the electron conductive layer 13 was found to be markedly lower than that of the ionic conductive layer 12. Further, the rubber hardness of the electron conductive layer 13 was found to be 43 as measured by the method specified in JIS A.

3) Fitting of the Tube over the Ionic Conductive Layer:

In the first step, the surface of the polished ionic conductive layer 12 was coated with an adhesive having an ionic conductivity. Then, an electron conductive tube 24 forming an electron conductive layer, which was mounted to a mold 23, was fitted over the ionic conductive layer 12 from one end side of the metal core 11 by using an air pressure, followed by applying a heat treatment to the electron conductive tube 24 so as to achieve a desired bonding. Further, both edges of the tube were cut to a predetermined size. On the other hand, the insulating annular sealing member 15 was prepared by coating the both side edges of the ionic conductive layer 12 and the cut tube (electron conductive layer 13) with an insulating rubber-based sealing material. Finally, the roll surface was ground so as to obtain a conductive roll of a two-layer structure having the both side edges sealed by the annular sealing member 15.

Figure 3:
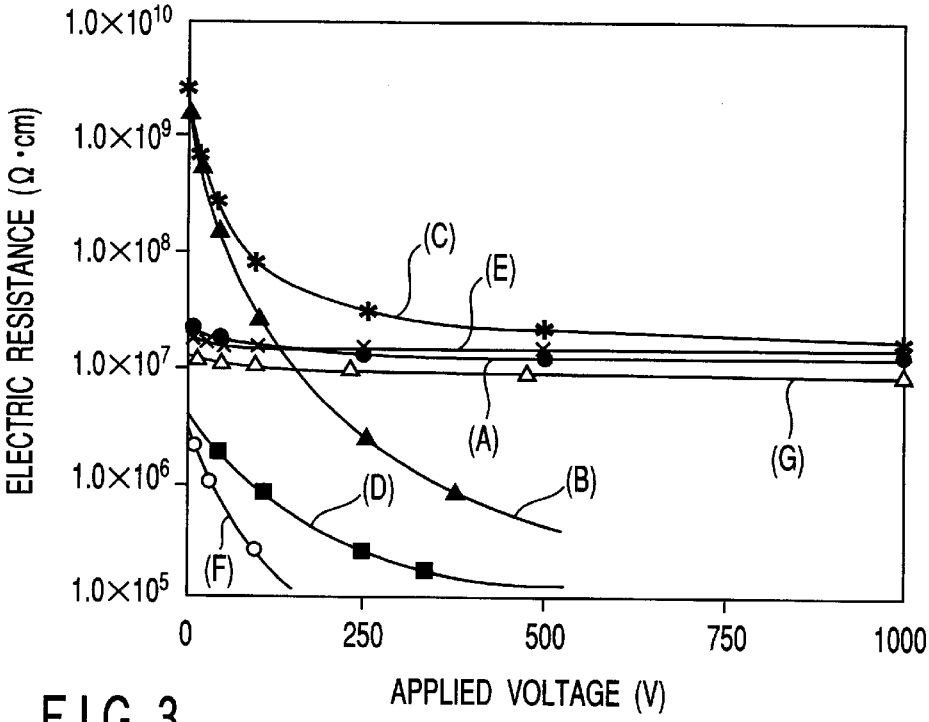
FIG. 3 is a graph showing the relationship between the electric resistance and the voltage applied to the ionic conductive layer and the electron conductive layer included in the conductive roll of the present invention.

Curve (C) shown in FIG. 3 shows the electrical characteristics, i.e., the relationship between the applied voltage and the electrical resistance, of the roll. The hardness of the roll was found to be 30 to 35 (JIS E). As apparent from curve (C) shown in FIG. 3, the resistivity of the roll exhibited a large dependence on the applied voltage, resulting in failure to exhibit desired electrical characteristics. What should be noted is that the electrical resistance of the ionic conductive layer 12 was found to be lower than that of the electron conductive layer 13, failing to satisfy the requirement of the conductive roll according to the first aspect of the present invention. The experimental data support that the electric resistance of the conductive roll is controlled by the electrical characteristics of the conductive layer having a high electrical resistivity.

EXAMPLE 1

A conductive roll according to one embodiment of the present invention, in which the electric resistance of the ionic conductive layer 12 is higher than that of the electron conductive layer 13, will now be described together with its manufacturing method.

1) Formation of the Ionic Conductive Layer 12:

The ionic conductive layer 12, which was spongelike, was prepared as in Comparative Example 1. The electrical characteristics of the ionic conductive layer 12, i.e., the relationship between the applied voltage and the electrical resistivity, was as shown in curve (A) shown in FIG. 3. To be more specific, the electrical resistivity of the ionic conductive layer 12 was found to be substantially constant at about $10^7$ Ω·cm regardless of the change in the applied voltage. The ionic conductive layer 12 was also found to be substantially equal to the ionic conductive layer 12 for Comparative Example 1 in the average cell diameter and the hardness.

2) Formation of the Electron Conductive Layer 13:

A raw material rubber consisting of 100 parts by weight of EPDM was mixed with a vulcanizing agent, a plasticizer and 25 parts by weight of HAF (carbon black) used as an electron conducting agent, and 28 parts by weight of a conductive zinc white, followed by kneading the mixture. Then, the process after the extrusion step was conducted as in Comparative Example 1 so as to form a tube of the electron conductive layer 13. The electrical characteristics of the tube, i.e., the relationship between the applied voltage and the electric resistivity, were found to be as denoted by a curve (D) in FIG. 3. In other words, the electric resistivity of the electron conductive layer 13 was found to be lower than that of the ionic conductive layer 12 over the entire region of the applied voltage. The rubber hardness of the electron conductive layer 13 was found to be 42 to 44 as measured by the method specified in JIS A.

3) Fitting of the Tube over the Ionic Conductive Layer:

A conductive roll of a two-layer structure having the both side edges sealed by the annular sealing member was prepared as in Comparative Example 1. The electrical characteristics of the tube, i.e., the relationship between the applied voltage and the electrical resistivity, were found to be as denoted by curve (E) shown in FIG. 3. As apparent from curve (E), the dependence of the electrical resistivity on the applied voltage was found to be low and, thus, the electric characteristics of the conductive roll were found to be satisfactory. The dependence of the electric resistivity of the conductive roll on the environment was also tested under the three environments given below:

HH Environment: temperature of 30° C., and relative humidity of 80%

NN Environment: temperature of 23° C., and relative humidity of 60%

LL Environment: temperature of 10° C., and relative humidity of 20%

Figure 4:
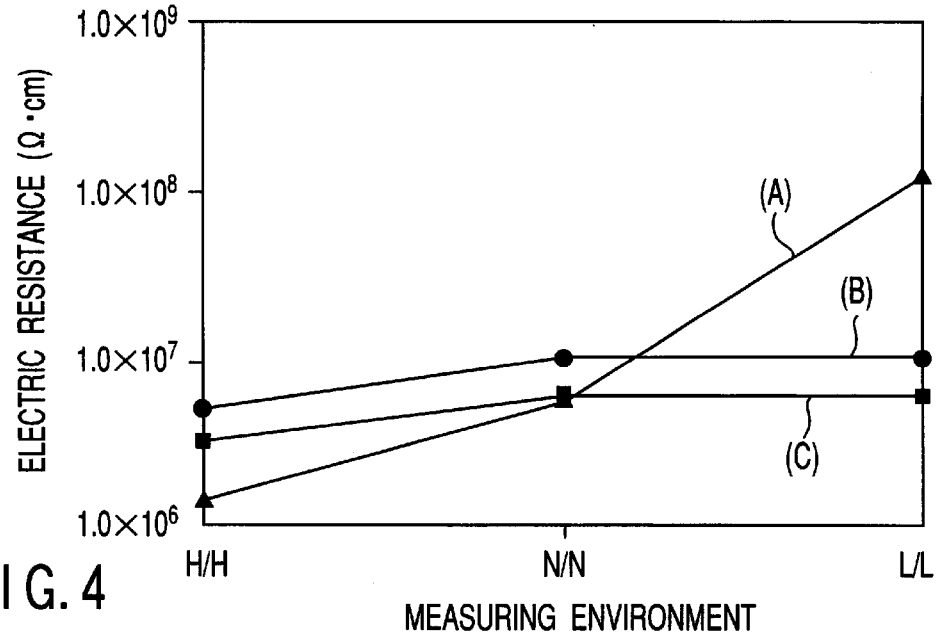
FIG. 4 is a graph showing the dependence of the ionic conductive layer and the electron conductive layer included in the conductive roll of the present invention on the environment.

The conductive roll prepared in Example 1 was left to stand for 48 hours under each of the three environments given above, followed by measuring the electrical resistivity of the conductive roll, with the results as shown in a graph of FIG. 4. Curve (A) given in FIG. 4 represents the environment dependence of the ionic conductive layer 12 formed to cover the outer circumferential surface of the core metal shaft 11. Curve (B) in FIG. 4 represents the environment dependence of the tube forming the electron conductive layer 13 in Example 1. Further, curve (C) in FIG. 4 represents the environment dependence of the conductive roll prepared by fitting the tube of the electron conductive layer 13 over the ionic conductive layer 12, followed by sealing the both edges of the ionic conductive layer 12 and the electron conductive layer 13 with the annular sealing member 15. The experimental data support that a conductive roll low in the environment dependence can be prepared by covering the ionic conductive layer 12 having a large environment dependence with the electron conductive layer 13 having a small environment dependence.

In Example 1, the conductive roll is of a two-layer structure consisting of the ionic conductive layer 12 having a high electric resistivity and the electron conductive layer 13 having a low electric resistivity and covering the outer circumferential surface of the ionic conductive layer 12. In addition, the both side edges of these conductive layers 12 and 13 are sealed by the annular sealing member. Since the ionic conductive layer 12 having a high hygroscopicity is covered with the electron conductive layer 13 and the annular sealing member 15, it is possible to obtain a conductive roll low in the environment dependence and in the voltage dependence. In addition, the conductive roll exhibits a low resistivity with a high stability.

As a matter of fact, the conductive roll in Example 1 was mounted to image forming apparatuses of an electrophotographic type such as a copying machine and a printer, and the applied voltage was changed within a range of between 10V and 1000V. The environmental conditions (NH, HH, LL) were also changed. However, it was possible to continue to obtain a high quality image with a high stability.

EXAMPLE 2

Figure 2:
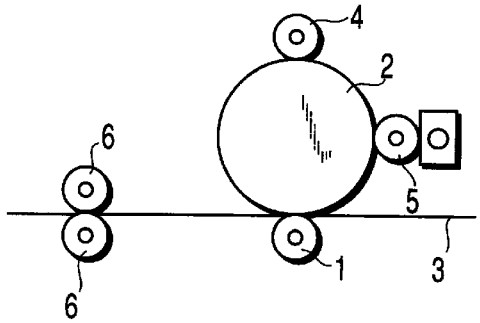
FIG. 2 shows how to use a transfer roll, a charging roll and a developing roll.

The conductive roll prepared in Example 1 was found to be low in its voltage dependence and environment dependence. When images were formed by mounting the conductive roll as the developing roll 5 shown in FIG. 2, satisfactory images were formed in the initial stage. However, when using a toner having a strong sticky force, the toner came to adhere to the roll with time in some cases, giving rise to contamination. In Example 2, a toner contamination preventing layer was formed on the electron conductive layer 13 in an attempt to overcome this problem. Specifically, the conductive roll in Example 2 was manufactured as follows:

1) The conductive roll prepared in Example 1, in which the ionic conductive layer 12 and the electron conductive layer 13 were used in combination, was used as the developing roll 5 shown in FIG. 2. The electric characteristics of the conductive roll, i.e., the relationship between the applied voltage and the electric resistivity, of the conductive roll was as denoted by curve (E) shown in FIG. 3. The conductive roll was also found to be equal to the conductive roll in Example 1 in the cell diameter and the hardness.

2) As a material of the toner contamination preventing layer 14, a conductive paste having the electric characteristics as denoted by curve (F) in FIG. 3 was prepared by kneading in a ball mill a mixture consisting of 100 parts by weight of KR9706 (trade name of an acryl-modified silicone resin paint manufactured by Shinetsu Kagaku, K.K.) and 15 parts by weight of Seast 3 (trade name of HAF carbon black manufactured by Tokai Carbon K.K.).

3) The surface of the conductive roll prepared in Example 1 was coated with the conductive paste prepared in item 2) above in a thickness of 15 to 20 $\mu$m by using a spray gun.

The electric characteristics, i.e., the relationship between the electric resistivity and the applied voltage, of the conductive roll of the three-layer structure were measured, with the result as denoted by curve (G) shown in FIG. 3. The conductive roll of the three-layer structure was mounted to image forming apparatuses of an electrophotographic system such as a copying machine and a printer, and image forming test was conducted by changing the applied voltage within a range of between 10V and 1000V. High quality images were formed from the initial period of the test. Also, the contamination with the toner was not found over a long operating period and, thus, high quality images were obtained with a high stability over a long period of time.

EXAMPLE 3

This Example is directed to a conductive roll comprising the ionic conductive layer 12 and the electron conductive layer 13 as shown in FIG. 1, in which the electric resistivity of the electron conductive layer 13 is lower than that of the ionic conductive layer 12, and the polyurethane resin is used for forming the ionic conductive layer 12. To be more specific, the conductive roll was prepared as follows:

1) Formation of tube used as electron conductive layer 13 arranged to cover the outer circumferential surface of ionic conductive layer 12:

Used was the tube prepared in Example 1.

2) The metal core 11 was arranged in the center of the tube referred to in item 1) above, i.e., a conductive tube 33, by using a lower mold 31 and an upper mold (lid) 32, as shown in FIG. 5.

3) The material of the ionic conductive layer 12 was prepared by mixing 100 parts by weight of MFP-300 (trade name of a liquid polyol polyurethane resin manufactured by Mitsui Chemical Co., Ltd.), 60 parts by weight of BF#300 (trade name of a filler manufactured by Shiroishi Calcium K.K.), 2 parts by weight of MFS-724 (trade name of a foam stabilizer manufactured by Mitsui Chemical Co., Ltd.), 2 parts by weight of MFC-725 (trade name of a reaction catalyst manufactured by Mitsui Chemical Co., Ltd.), 43 parts by weight of Coronate PZ601 (trade name of a crosslinking agent manufactured by Nippon Polyurethane Industry, Co., Ltd.), and 18 parts by weight of US-600-⑥

(trade name of a conductive plasticizer used as an ionic conducting agent and manufactured by Sanken Chemical Co., Ltd.). The composition was found to exhibit electrical characteristics (relationship between the electric resistivity and the applied voltage) denoted by curve (A) shown in FIG. 3.

Figure 5A:
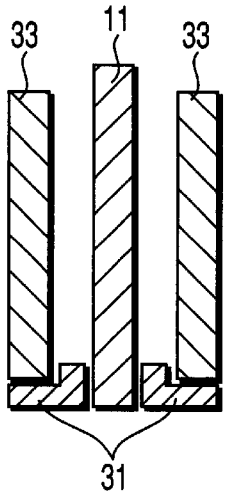
FIGS. 5A and 5B collectively show how to power a liquid polymer elastomer mixed with an ionic conductive agent into the free space between the electrically conductive tube and the metal core.
Figure 5B:
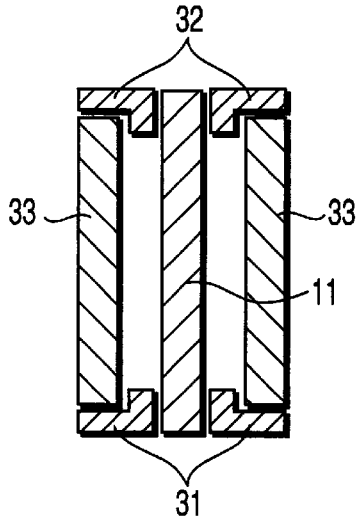

4) The liquid urethane composition mechanically stirred to bring about foaming was poured into the mold shown in FIG. 5A, followed by closing the mold with the upper mold 32 as shown in FIG. 5B.

5) After the curing by heating, the upper mold 32 and the lower mold 31 were detached, followed by cutting the both edges of the roll with a cutter.

6) The cut surfaces on both edges were coated with KE45RTV Silicone Rubber (trade name of a sealing material that can be cured at room temperature, which was manufactured by Shinetsu Kagaku K.K.) to form the annular sealing member 15.

7) The surface of the annular sealing member 15 was polished, and the electric resistivity was measured, with the result as denoted by curve (E) shown in FIG. 3.

The conductive roll prepared in Example 3 was mounted to image forming apparatuses of an electrophotographic type such as a copying machine and a printer, and the applied voltage was changed within a range of between 10V and 1000V. The environmental conditions (NH, HH, LL) were also changed. However, it was possible to continue to obtain a high quality image with a high stability.

EXAMPLE 4

Figure 8:
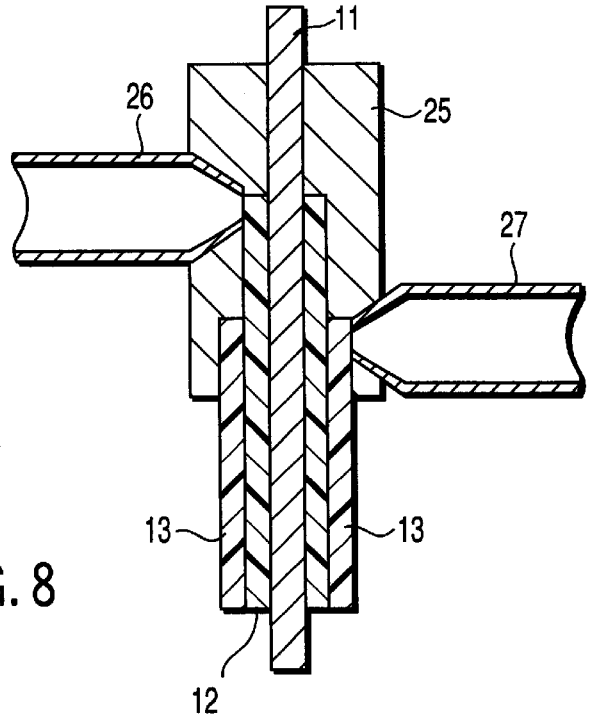
FIG. 8 shows a double extruder used for forming a conductive roll of the present invention.

This Example is directed to a conductive roll comprising the ionic conductive layer 12 and the electron conductive layer 13 as shown in FIG. 1, in which the electric resistivity of the electron conductive layer 13 is lower than that of the ionic conductive layer 12, and the ionic conductive layer 12 and the electron conductive layer 13 were prepared by an extrusion molding using a simultaneous twin screw type extruder shown in FIG. 8.

As shown in FIG. 8, a first extruder 26 and a second extruder 27 are arranged to a cross head 25 serving to set the metal core 11. The first extruder 26 serves to supply the material of the ionic conductive layer to cover the outer circumferential surface of the metal core 11. On the other hand, the second extruder 27 serves to supply the material of the electron conductive layer to cover the outer circumferential surface of the ionic conductive layer.

To be more specific, the conductive roll was prepared as follows:

1) Composition 1) used in Example 1 was used as the composition for forming the ionic conductive layer 12 arranged to cover the outer circumferential surface of the metal core 11.

2) Composition 2) used in Example 1 was used as the composition for forming the electron conductive layer arranged to surround the outer circumferential surface of the ionic conductive layer.

3) Compositions 1) and 2) given above were simultaneously extruded by using a twin screw type extruder manufactured by Mitsuba Seisakusho K.K. to form by extrusion molding the ionic conductive layer 12 to surround the outer circumferential surface of the metal core 11 and to form the electron conductive layer 13 to surround the outer circumferential surface of the ionic conductive layer 12.

4) The structure given in item 3) above was heated for vulcanization and foaming so as to obtain a desired conductive roll.

5) Both edges of the conductive roll obtained in item 4) above were cut to a predetermined size, followed by coating the cut surfaces on both edges with KE45RTV Silicone Rubber manufactured by Shin-Etsu Chemical Co., Ltd. so as to form the annular sealing member 15.

6) The surface of the conductive roll referred to in item 5) above was polished to a predetermined size, followed by measuring the electric resistivity. The resistivity was found to be constant and stable regardless of changes in the applied voltage, as denoted by curve (E) given in FIG. 3.

The conductive roll prepared in Example 4 was mounted to image forming apparatuses of an electro-photographic type such as a copying machine and a printer, and the applied voltage was changed within a range of between 10V and 1000V. The environmental conditions (NH, HH, LL) were also changed. However, it was possible to continue to obtain a high quality image with a high stability.

In the Examples described above, an ionic conductive layer, an electron conductive layer, a toner contamination preventing layer were formed successively to cover the outer circumferential surface of the core metal shaft, and an annular sealing member was formed on each of side edges of the ionic conductive layer and the electron conductive layer both extending in the longitudinal direction of the core metal shaft. However, the present invention is not limited to the particular construction. For example, it is possible to omit the annular sealing member.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A conductive rubber roller, comprising:

a metal core connected to a power source;

an ionic conductive layer containing an ionic conducting agent and formed to surround the outer surface of the core metal shaft; and an electron conductive layer formed to surround the outer surface of the ionic conductive layer and consisting of a high molecular weight elastomer containing an electron conducting agent or a high molecular weight cellular elastomer containing an electron conducting agent, wherein said ionic conductive layer consists of a high molecular weight elastomer, a polymer alloy thereof, a high molecular weight cellular elastomer, or a polymer alloy thereof, and an electric resistance R1 of said ionic conductive layer is higher than an electric resistance R2 of said electron conductive layer (R1>R2).

2. A conductive rubber roller, comprising:

a metal core connected to a power source;

an ionic conductive layer containing an ionic conducting agent and formed to surround the outer surface of the core metal shaft;

an electron conductive layer formed to surround the outer surface of the ionic conductive layer and consisting of a high molecular weight elastomer containing an electron conducting agent or a high molecular weight cellular elastomer containing an electron conducting agent; and an insulating annular sealing member mounted to each of both edges of said ionic conductive layer and said electron conductive layer both extending in a longitudinal direction of the core metal shaft, wherein said ionic conductive layer consists of a high molecular weight elastomer, a polymer alloy thereof, a high molecular weight cellular elastomer, or a polymer alloy thereof, an electric resistance R1 of said ionic conductive layer is higher than an electric resistance R2 of said electron conductive layer (R1>R2), and said annular sealing member exhibits an electric resistance of at least $10^{13}$ Ω·cm.

3. A conductive rubber roller according to claim 1, wherein a toner contamination preventing layer is formed to cover the outer circumferential surface of said electron conductive layer, and a relationship R1>R2>R3, where R3 denotes the electric resistance of said toner contamination preventing layer, is satisfied.

4. A conductive rubber roller according to claim 2, wherein a toner contamination preventing layer is formed to cover the outer circumferential surface of said electron conductive layer, and a relationship R1>R2>R3, where R3 denotes the electric resistance of said toner contamination preventing layer, is satisfied.

* * * * *